US005619835A

United States Patent [19]

Bailey, II et al.

[11] Patent Number: 5,619,835

[45] Date of Patent: Apr. 15, 1997

[54] MODULAR BLOCK RETAINING WALL SYSTEM

[75] Inventors: Joseph S. Bailey, II, Roswell; Robert Miller, Marietta; Joseph D. Emberson, Roswell, all of Ga.

[73] Assignee: The Tensar Corporation, Atlanta, Ga.

[21] Appl. No.: 591,319

[22] Filed: Jan. 25, 1996

[51] Int. Cl.[6] ..... E04C 2/04

[52] U.S. Cl. ..... 52/606; 52/585.1; 52/285.1; 405/286

[58] Field of Search ..... 52/596, 602, 604, 52/607–609, 605, 606, 585.1, 285.1, 285.4, 379; 405/284–286

[56] References Cited

U.S. PATENT DOCUMENTS

| | | | |
|---|---|---|---|
| Re. 34,314 | 7/1993 | Forsberg . | |
| D. 250,484 | 12/1978 | Muse . | |
| D. 296,007 | 5/1988 | Forsberg . | |
| D. 296,365 | 6/1988 | Forsberg . | |
| D. 297,464 | 8/1988 | Forsberg . | |
| D. 297,574 | 9/1988 | Forsberg . | |
| D. 297,767 | 9/1988 | Forsberg . | |
| D. 298,463 | 11/1988 | Forsberg . | |
| D. 346,031 | 4/1994 | Risi et al. . | |
| D. 350,611 | 9/1994 | Scales . | |
| 844,416 | 2/1907 | Sewall et al. | 52/605 |
| 991,722 | 5/1911 | Hourd . | |
| 1,751,272 | 3/1930 | Forman . | |
| 1,992,785 | 2/1935 | Steuer . | |
| 2,201,110 | 5/1940 | Makram . | |
| 3,325,956 | 6/1967 | Moraetes | 52/606 |
| 3,461,631 | 8/1969 | Brugnola . | |
| 3,609,926 | 10/1971 | Muse . | |
| 3,686,873 | 8/1972 | Vidal . | |
| 4,031,678 | 6/1977 | Schuring . | |
| 4,068,482 | 1/1978 | Hilfiker . | |

(List continued on next page.)

FOREIGN PATENT DOCUMENTS

| | | |
|---|---|---|
| 2075580 | 8/1992 | Canada . |
| WO85/03535 | 8/1985 | WIPO . |
| WO94/13890 | 6/1994 | WIPO . |

OTHER PUBLICATIONS

"Concrete Geowall Package", Tensar, 10 Pages.

"Minislope System", Permacon, pp. 1593–1594.

Newcastle "Retaining Wall Systems"—Technical Data, 1 page.

Newcastle, "Retaining Wall Systems", Elements of the System, 3 pages.

*Primary Examiner*—Carl D. Friedman
*Assistant Examiner*—Beth Aubrey
*Attorney, Agent, or Firm*—Jacobson, Price, Holman & Stern, PLLC

[57] ABSTRACT

A modular wall block is formed with a groove in a top surface configured to frictionally receive fingers of a rake-like connection device which may extend through apertures in an end portion of a grid-like sheet of reinforcing material. The connection device includes enlarged tabs projecting away from the fingers to engage in a widened slot defined in the bottom of superimposed wall blocks for positioning the front faces of the blocks in the retaining wall relative to each other in either a vertically aligned or vertically set back relationship depending upon the direction of extension of the tabs. The groove and the slot are formed at opposite ends of a tapered through-opening extending between top and bottom surfaces of the block. By virtue of the taper, the width of the groove is less than a width of the slot to accommodate the different portions of the connector device. Both the groove and the slot, as well as other selected depressions and recesses can be formed from one side of the block during manufacture to simplify the manufacturing equipment and minimize the cost of the wall blocks. Corner blocks are provided having perpendicular front and side surfaces with similar aesthetic patterns for forming corner portions of sections of a retaining wall extending at right angles to each other.

22 Claims, 11 Drawing Sheets

U.S. PATENT DOCUMENTS 4,123,881 11/1978 Muse .
4,186,540 2/1980 Mullins .
4,324,508 4/1982 Hilfiker et al. .
4,374,798 2/1983 Mercer .
4,454,699 6/1984 Strobl ..... 52/585.1
4,470,728 9/1984 Broadbent .
4,616,959 10/1986 Hilfiker .
4,661,023 4/1987 Hilfiker .
4,781,492 11/1988 Shindo ..... 52/606 X
4,802,320 2/1989 Forsberg .
4,825,619 5/1989 Forsberg .
4,887,403 12/1989 Bonner ..... 52/605 X
4,914,876 4/1990 Forsberg .
4,964,761 10/1990 Rossi ..... 52/606 X
5,044,834 9/1991 Janopaul, Jr. .
5,064,313 11/1991 Risi et al. .
5,066,169 11/1991 Gavin et al. .
5,122,015 6/1992 Shen .
5,145,288 9/1992 Borcherdt .
5,154,542 10/1992 Klenert .
5,163,261 11/1992 O'Neill ..... 52/610
5,214,898 6/1993 Beretta .
5,248,226 9/1993 Risi et al. .
5,257,880 11/1993 Janopaul, Jr. .
5,417,523 5/1995 Scales .

MODULAR BLOCK RETAINING WALL SYSTEM

FIELD OF THE INVENTION

This invention relates to a modular wall block system, and particularly to a modular wall block system incorporating a connector device to mechanically secure extended lengths of grid-like sheets of material to selected courses of such wall blocks used to form a reinforced retaining wall or the like. The wall blocks of this invention are designed for ease in positioning and locating individual blocks relative to each other during construction of retaining walls.

BACKGROUND OF THE INVENTION

Retaining walls are commonly used for architectural and site development applications. In civil engineering structures, the wall facing must withstand very high pressures exerted by backfill soils. Reinforcement and stabilization of the soil backfill is commonly provided by grid-like sheet materials that are placed in layers in the soil fill behind the wall face to interlock with the wall fill soil and create a stable reinforced soil mass. Connection of the reinforcing material to the elements forming the wall holds the wall elements in place and resists soil backfill pressures.

A preferred form of grid-like tie-back sheet material used to reinforce the soil behind a retaining wall structure, known as an integral geogrid, is commercially available from The Tensar Corporation of Atlanta, Ga. ("Tensar") and is made by the process disclosed in U.S. Pat. No. 4,374,798 ("the '798 patent"), the subject matter of which is incorporated herein in its entirety by reference. However, other forms of grid-like tie-back sheet materials have also been used as reinforcing means in the construction of retaining walls, and the instant inventive concepts are equally applicable with the use of such materials. Regardless of the particular tie-back, difficulties are encountered in providing a secure interconnection between the reinforcing means and the wall elements, especially in areas of high earthquake (seismic) activity.

In a brochure entitled "Concrete Geowall Package", published by Tensar in 1986, various retaining wall structures are shown using full height cast concrete panels. In one such retaining wall structure, short strips or tabs of geogrid material, such as shown in the '798 patent, are embedded in the cast wall panels. On site, longer strips of geogrid are used to reinforce the wall fill, creating a stable soil mass. To connect the geogrid tabs to the reinforcing geogrid, the strands of one portion of geogrid are bent to form loops, the loops are inserted between the strands of the other portion of geogrid so that the loops project out of the second portion of geogrid, and a rod is passed through the loops on the opposite side of the second portion to prevent the loops being pulled back through, thereby forming a tight interconnection between the two portions of geogrid, sometimes referred to as a "Bodkin" joint.

Use of full height pre-cast concrete wall panels for wall-facing elements in a retaining wall requires, during construction, that the panels be placed using a crane because they are very large, perhaps 8 by 12 feet or even larger and, as a result, are quite heavy such that they cannot be readily manhandled. To avoid such problems in the use of pre-cast wall panels other types of retaining wall structures have been developed. For example, retaining walls have been formed from modular wall blocks which are typically relatively small as compared to cast wall panels. The assembly of such modular wall blocks usually does not require heavy equipment. Such modular wall blocks can be handled by a single person and are used to form retaining wall structures by arranging a plurality of blocks in courses superimposed on each other, much like laying of brick or the like. Each block includes a body with a front face which forms the exterior surface of the retaining wall.

Modular wall blocks are formed of concrete, commonly mixed in a batching plant with only enough water to hydrate the cement and hold the unit together. Such blocks may be commercially made by a high-speed process which provides a mold box having only sides, without a top or bottom, positioned on top of a steel pallet which contacts the mold box to create a temporary bottom plate. A concrete distributor box brings concrete from the batcher and places the concrete in the mold box and includes a blade which levels the concrete across the open top of the mold box. A stripper/compactor is lowered into the open, upper end of the box to imprint the block with a desired pattern and to compress the concrete under high pressure. The steel pallet located at the bottom of the mold box resists this pressure.

A vibrator then vibrates the mold box to aid in concrete consolidation. After approximately one-half to four seconds, the steel pallet is moved away from the bottom of the mold box which has been positioned above a conveyor belt. The stripper/compactor continues to press on the formed concrete to push the modular wall block out of the mold box onto the conveyor belt. This process takes about seven to nine seconds to manufacture a single wall block. The formed wall block is cured for approximately one day to produce the final product.

With this high-speed method of construction, it is not practical to embed short strips or tabs of grid-like material in the blocks in the manner of the pre-cast wall panels shown in the Tensar brochure to enable interconnection with a grid-like reinforcing sheet material directly or by a Bodkin-type connection or the like. Therefore, other means for securing the reinforcing grid to selected modular blocks used to construct a retaining wall have had to be devised.

Most such techniques actually secure end portions of a sheet of reinforcing grid between layers of wall blocks, relying primarily on the weight of superimposed blocks to provide a frictional engagement of the reinforcing means between large surface areas of superimposed wall blocks to form a retaining wall. The nature of the large surface area of cementitious wall blocks having very rough surfaces contacting the reinforcing means tends to abrade, and thereby weaken, a polymeric sheet reinforcing material at the very point of interconnection with the retaining wall. Moreover, and most importantly, reliance on the weight of superimposed blocks to provide the primary grid-to-block connection strength is ineffective during an earthquake or other such seismic event where vertical accelerations, i.e., the actual momentary lifting of upper courses of wall blocks, decrease or totally eliminate the weight of superimposed blocks, thereby significantly reducing or eliminating the connection strength and jeopardizing the stability of the retaining wall and the soil mass retained thereby.

In an attempt to overcome such disadvantages, a modular wall block system as disclosed in copending U.S. application Ser. No. 08/254,710, filed Jun. 6, 1994, commonly assigned with the instant application and incorporated herein in its entirety by reference, has been developed. The upper surface of the wall blocks in the system of the '710 application is recessed to accommodate the end portions of a sheet of grid-like reinforcing material and a groove is formed across the recessed portion, parallel to, and set back from, the front face. A plurality of spaced teeth or fingers projecting from a common spine or cross bar of a comb-like grid connection device are passed downwardly through the apertures on the end portions of the grid sheet and frictionally engaged in the groove to positively secure the grid to the block without reliance on the weight of a superimposed course of blocks. Thus, the grid-like sheet of metal is securely retained by the grid connection device even in the event of a vertical acceleration of the wall blocks which may occur during an earthquake or the like.

The grid connection device may be formed of steel, aluminum, fiberglass, a plastic reinforced with fiberglass or, preferably, a high strength polymer. The fingers may be provided with serrations to enhance the frictional engagement with the sidewalls of the groove in the wall block and lock the connection device in place. Thus, load is transferred from the grid-like sheet of material through the fingers and spine of the connection device to the modular wall block.

An improved modular wall block system is disclosed in commonly assigned, copending U.S. application Ser. No. 08/370,324, filed Jan. 10, 1995, also incorporated herein in its entirety by reference. In addition to the groove in the upper surface of the wall blocks of the '324 application, a slot is formed in the lower surface, parallel to, and set back from, the front face. The slot in the lower surface is wider than the groove in the upper surface. In this system the comb-like grid connection device is also provided with a plurality of spaced tabs which extend upwardly from the spine to slidingly engage in the slots of superimposed wall blocks when the retaining wall is being built. The tabs are wider than the fingers in a direction transverse to the spine. Thus, if one edge of the fingers are aligned with one edge of the tabs, the other edge of the tabs extend beyond the other edge of the fingers. As described in detail in the '324 application, by properly dimensioning the tabs vis-a-vis the set back of the slot, the front faces of superimposed courses of wall blocks in a retaining wall may selectively be vertically aligned or stepped back by turning the grid connection device 180° about a vertical axis in use.

While the use of a grid connection device with integral grid-connecting fingers and block-locating tabs is highly desirable in the construction of a retaining wall, the manufacture of wall blocks having indentations pressed into both their upper and lower surfaces toward the center is difficult, requiring high cost equipment and time-consuming manufacturing techniques.

Accordingly, there is a need to improve the design of a modular wall block according to this invention to facilitate block manufacture at higher speed, requiring less complicated equipment, and thereby minimizing cost of manufacture and ultimately, the cost of a retaining wall produced from such blocks. The ability to minimize the complexity and cost of production equipment would also facilitate the manufacture of such blocks by smaller facilities closer to the job site thereby avoiding the inordinately high cost associated with transporting centrally manufactured blocks over long distances because of their weight and volume. The modified design of the modular wall blocks of this invention overcomes these and other problems with the prior art.

SUMMARY OF THE INVENTION

It is, therefore, a primary object of this invention to provide a simple and inexpensive modular wall block system formed of a plurality of wall blocks and including a connection means for selectively positioning the front faces of superimposed courses of wall blocks either vertically or stepped back, where the connection means may also positively secure extended lengths of grid-like reinforcing sheet material to the wall blocks, if desired.

A further object of this invention is the provision of such a modular wall block system where the wall blocks each have openings facing their upper and lower surfaces of different widths for reception, respectively, of the fingers and tabs of a connection device, with the openings on both surfaces having been molded from only one surface of the block, minimizing the need for sophisticated and expensive manufacturing equipment and enabling high speed production of such wall blocks by smaller companies located closer to the work site.

Still another object of the invention is the provision of modular wall blocks having a tapered through-opening defining a transversely extending groove on one surface of the wall block for frictional reception of the fingers of a connection device and a wider transversely extending slot on the opposite surface for sliding reception of the locating tabs on the connection device. For ease of manufacture, each block may be initially formed with the wider portion of the through-opening facing upwardly by the appropriate placement of the tapered molding element in the mold. The block is pressed downwardly through the mold for easy removal of the block from the mold. The block can then be inverted in use so the fingers of the grid connection device can be driven downwardly into frictional engagement with the smaller groove in constructing a retaining wall.

Thus, according to a preferred embodiment of the instant inventive concepts, the smaller end portions of the tapered through-opening define a central groove in the lower surface of each wall block as manufactured, the upper surface as used. The groove is parallel to, and spaced rearwardly from, the front face of the block, for frictional reception of the fingers of a connection device.

Central portions of a wider slot are formed in the opposed surface of each wall block, the upper surface as manufactured and the lower surface as used, by the same tapered through-opening. Like the groove, the slot extends parallel to, and is spaced rearwardly from, the front face surface of the block. The central portions defined by the wider end of the through-opening may be extended to the sides of the block by aligned slot end portions pressed into the block surface at the same time that the through-opening is formed. The provision of a continuous slot extending fully across the block enables the locating tabs of a connection device secured in a lower wall block to be slidingly received in aligned slots of a pair of laterally staggered wall blocks in a superimposed course.

According to an alternate form of wall block according to this invention, particularly useful in the producing of corner wall blocks where slots extending to the side surfaces are aesthetically undesirable, the tapered through-opening may define aligned portions of grooves and slots extending parallel to, and spaced rearwardly from, the front face of the block to receive shorter sections of connection devices in a similar manner.

As indicated, all recesses are preferably formed in the block in the mold on the upper surface. Due to the speed of manufacture, it is much easier to impart depressions or openings into the uppermost surface of the block while in the mold. It is also easier to include mold elements to form tapered openings extending through the block, with the opening becoming progressively wider from the top surface as formed to the bottom surface as formed for ease of release of the mold elements from the molded blocks.

Accordingly, the wall block is manufactured with the wider end of the through-opening on its upper surface. However, in use, the smaller end of the through-opening must face upwardly to enable the fingers of the connection device to be driven downwardly, through preformed openings of a grid-like reinforcing sheet or to perforate a reinforcing sheet or wedge the same, into frictional engagement with the block. Therefore, once removed from the mold, the block is inverted in use.

As indicated, a preferred grid-like sheet reinforcing material may be made according to the techniques disclosed in the above-identified '798 patent. Preferably, uniaxially-oriented geogrid materials as disclosed in the '798 patent are used, although biaxial geogrids or grid materials that have been made by different techniques such as woven, knitted or netted grid materials formed of various polymers including the polyolefins, polyamides, polyesters and the like or fiberglass, may be used. In fact, any grid-like sheet material, including steel (welded wire) grids, with interstitial spaces capable of being secured to selected modular wall blocks with the connection device of the instant invention in the manner disclosed herein are suitable. In addition, it is possible that felt-like fabrics including woven or non-woven, solid or perforated geofabrics, geomats, or even composite materials including some form of geofabric and/or geogrid laminate may be used as the reinforcing material according to this invention. All of such materials are sometimes referred to herein and in the appended claims as "grid-like sheets of material", whether they are formed with apertures or not.

If the "grid-like" reinforcing sheets are not initially formed with apertures such as in a geofabric or the like, the fingers of the connection device may be used to actually puncture or perforate the sheet in use to secure the same to the modular wall blocks of the invention. In fact, it will be readily recognized that the sheet material need not even be perforated to produce a secure attachment to the modular wall blocks; the groove in the block and the fingers of the connection device can be dimensioned to wedge a section of the reinforcing sheet in the groove when the fingers of the connection device are driven into the groove.

With the preferred reinforcing material of the '798 patent, a high strength geogrid is formed by stretching an apertured plastic sheet material. Utilizing the uniaxial techniques, a multiplicity of molecularly-oriented elongated strands and transversely extending bars which are substantially unoriented or less-oriented than the strands, are formed. The strands and bars together define a multiplicity of grid openings. With biaxial stretching, the bars are also formed into oriented strands. In either event, or when using other grid-like sheets of material, the fingers of the grid connection device are spaced apart equal to a spacing between strands of the grid-like sheet of material, but may also be spaced apart several times the spacing between strands of the grid-like sheet of material such that some, but not necessarily every, grid opening receives a finger.

With the molding technique discussed above, the block may simultaneously be provided with an offset portion to accommodate thicker portions of the grid-like reinforcing sheet material, such as the cross-bar of a uniaxial integral geogrid made according to the '798 patent. As noted, in certain embodiments the slot formed by the through-opening may be provided with aligned end portions which extend to the sides of the block to facilitate slidingly positioning laterally staggered blocks in superimposed courses of wall blocks. The tapered through-opening, any offset portion and the slot end portions may all be molded into one surface of the block according to this invention, avoiding the need for equipment capable of providing shaped portions on both block surfaces.

At a construction site, a plurality of modular wall blocks are commonly stacked in laterally staggered, vertically superimposed, courses. When constructing a retaining wall of limited height, generally less than six feet, and usually straight, such as may be formed in a residential setting, the fingers of the connection device may be secured within the groove on the upper surface of each block defined by the limited width, transversely extending, aperture formed at one end of the through-opening. The limited width, transversely extending slot defined by the other end of the through-opening in the lower surface of superimposed wall blocks may cooperate with the upwardly projecting tabs on the connection device, with the slot extended to the sides of the block as described above, if desired. Depending on the orientation, of the connection device vis-a-vis the lower blocks, the locating tabs may selectively position the front faces of the stacked courses of wall blocks in a vertically aligned or vertically set-back orientation.

For walls of greater than six feet in height, or where desired, the fingers of the connection device may be secured in selected blocks so as to capture the end portions of elongated lengths of sheets of reinforcing material, the remainder of which is stretched out and interlocked with the fill soil or aggregate behind the retaining wall. In this manner, the sheets of grid-like sheet of material reinforce the fill so as to cremate a stable mass behind the retaining wall.

The various embodiments of modular wall block of the present invention cooperate with the connection device to achieve the enumerated benefits. The basic modular wall block is preferably about 7 ⅝ inches high, 16 inches wide at its front face, 9 ½ inches wide at its rear face and 11 inches deep, weighing approximately 75 pounds. Obviously, these parameters may vary widely without departing from the instant invention concepts and are intended to illustrate the preferred dimensions. The block, as used, includes a front face, a rear face, upper and lower surfaces and, except in the corner embodiment, rearwardly converging opposed side surfaces. A tapered through-opening extends between the upper and lower surfaces to define a centrally located, transverse groove in one surface, and a centrally located, transverse slot in the other surface. Preferably, the surface where the slot is formed is recessed to accommodate the spine of the connection device and optionally, end portions of a grid-like sheet of material. The block may be provided with other openings or cut-out portions, as desired, to reduce its weight and provide finger-engaging surfaces to facilitate lifting and placing the blocks in use.

The alternate form of a modular wall block according to the present invention may include substantially flat upper and lower surfaces with a single through-opening extending between a centrally located groove and a centrally located slot in opposite surfaces. In this embodiment, particularly when the block is to be used for forming the corner of a retaining wall, the slots are not extended to the side surfaces and shorter lengths of connector device are required. The alternative embodiment wall block, as manufactured, is preferably about 7 ⅝ inches high, 18 inches wide and 8 inches deep. These alternative blocks may be used as corner blocks in combination with the basic wall blocks of this invention or they may be used to form retaining walls, generally of limited height, by themselves, with or without grid-like reinforcing material.

Other forms of modular wall blocks which may be used as corner blocks are disclosed in commonly assigned U.S. application Ser. No. 08/591,266, filed simultaneously herewith in the name of Joseph S. Bailey, the disclosure of which is incorporated herein in its entirety by reference.

The modular wall blocks of this invention are preferably molded as double blocks, and then split transversely to form a roughened or jagged exterior facing for aesthetic reasons. To form a jagged exterior face at a corner surface, a side portion of the corner block can be broken away in the same way.

The above and other objects of the invention, as well as many of the attendant advantages thereof, will become more readily apparent when reference is made to the following detailed description, taken in conjunction with the accompanying drawings.

DETAILED DESCRIPTION OF THE PREFERRED EMBODIMENTS

Figure 1:
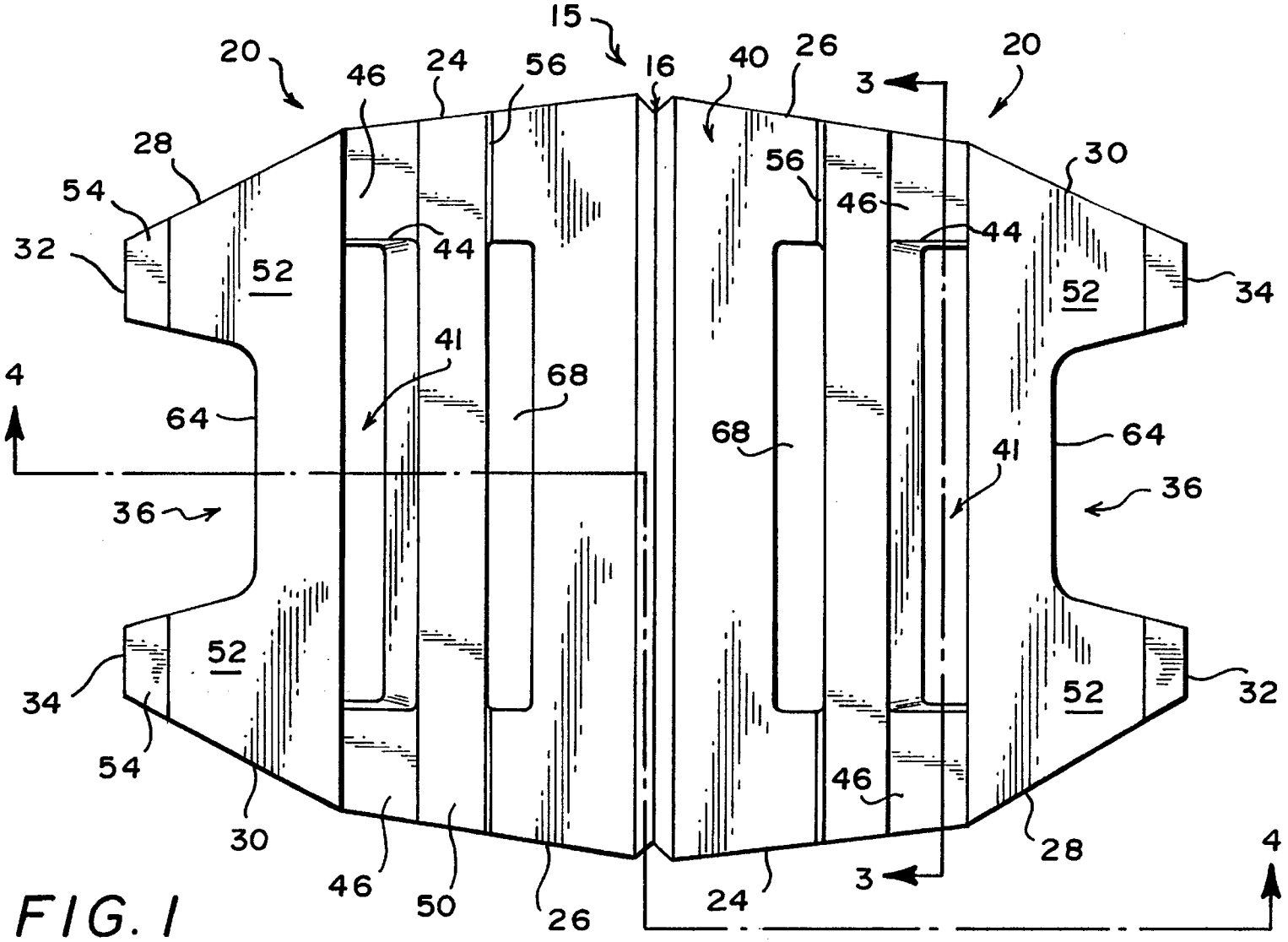
FIG. 1 is a plan view of a molded double basic wall block according to this invention which, when split and inverted, forms two separate wall blocks with jagged front faces.
Figure 2:
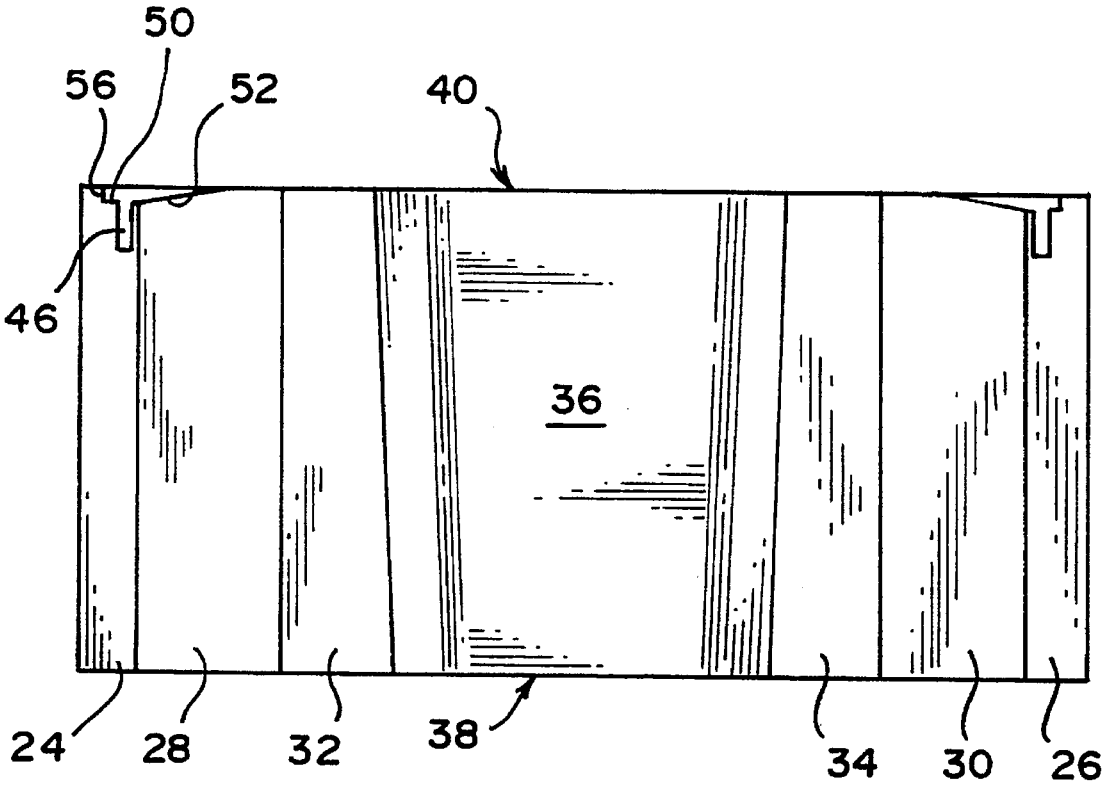
FIG. 2 is a rear elevational view of a basic wall block according to this invention.
Figure 3:
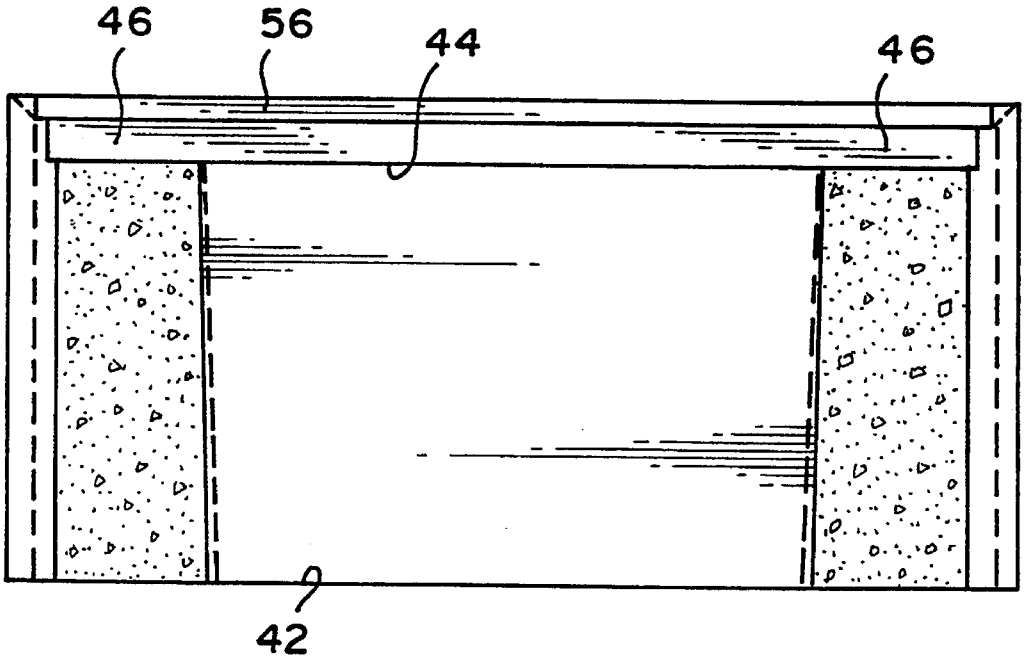
FIG. 3 is a sectional view taken along line 3—3 of FIG. 1.
Figure 4:
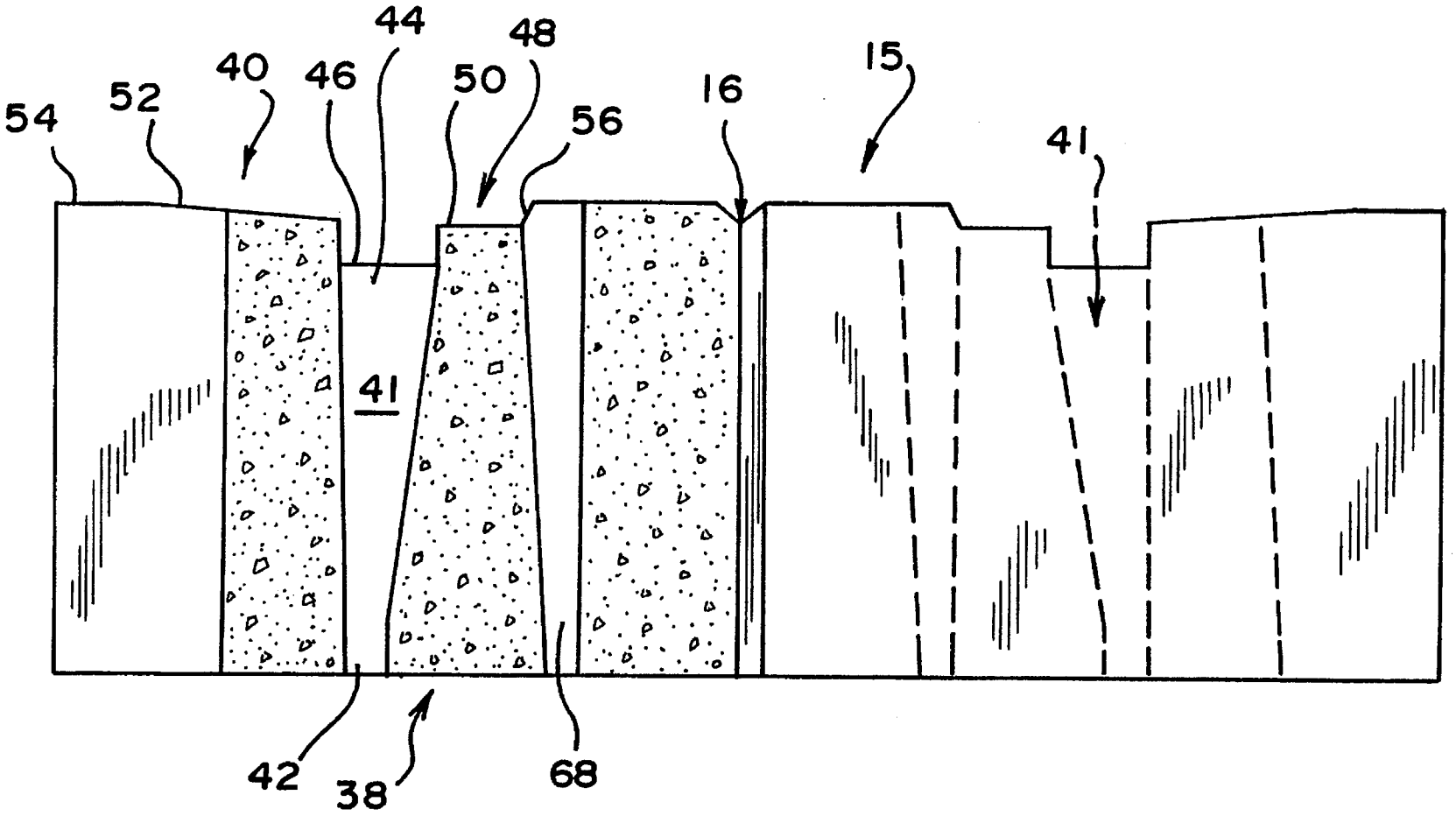
FIG. 4 is a partial cross-sectional view taken along line 4—4 of FIG. 1.

In describing preferred embodiments of the invention as illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose. Further, while preferred dimensions are set forth to describe the best mode currently known for the modular wall block system of this invention, these dimensions are illustrative and not limiting on the instant inventive concepts.

While a retaining wall formed by assembling a multiplicity of modular wall blocks according to this invention is shown in some of the drawings as providing a vertical exterior facing surface, as is well known, succeeding courses of modular wall blocks are commonly shifted slightly rearwardly for stability and appearance. As explained in more detail below, the instant inventive concepts readily enable the construction of a retaining wall having either design.

Further, while the preferred embodiment hereof is shown and described with reference to a uniaxially-oriented polymer geogrid such as is disclosed in the '798 patent, alternative grid-like tie-back reinforcing sheet materials may be substituted therefor, including grid-like sheet materials manufactured using weaving, knitting or netting techniques and also steel (welded wire) grid, geonets, geofabrics, solid sheet materials or composites may be used as well.

With reference now to the drawings in general, and FIGS. 1 through 4 in particular, a preferred embodiment of a basic modular wall block as cast according to this invention is shown. It is common practice to initially mold double blocks designated generally by the reference numeral 15. The double block 15 is provided with a peripheral groove 16 which may be impacted with a chisel or other pointed device (not shown) to split the double block 15 apart to form a pair of modular wall blocks 20, each of which has an aesthetic jagged front face 22.

For ease of manufacture, the double blocks 15 are cast upside down with reference to their orientation in use. Accordingly, when referring to FIGS. 1–4, the description of the wall blocks of the present invention will be made with the understanding that the individual wall blocks 20 resulting from splitting a double wall block 15, will be inverted when used to construct a retaining wall therefrom.

Each wall block 20, in addition to the front face 22, comprises rearwardly converging sidewalls 24, 26 with more sharply converging rearward portions 28, 30, rear wall portions 32, 34 interconnected by portions defining an arcuate cut-out 36, a first surface 38, which is the lower surface of the double block 15 during manufacture and will be the upper surface of the wall block 20 in use, and a second surface 40, which is the upper surface of the double block 15 during manufacture and will be the lower surface of the wall block 20 in use.

An elongated tapered opening 41 extends through each block 20 between surfaces 38 and 40 and is formed by tapered molding elements extended into the mold cavity (not shown) during manufacture of the double block 15. The through-opening 41 terminates in a transversely extending aperture defining a groove 42 extending partially across the first (or upper) surface 38 of the wall block 20, parallel to, and spaced rearwardly of, the front face 22 to frictionally receive the fingers of a grid connection device as described further hereinafter. Preferably the groove 42 is about 1.1 inch wide (from front to rear) and about 9.25 inches long (from side to side).

On the opposite, second (or lower) surface 40 of wall block 20, the through-opening 41 terminates in a transversely extending aperture defining a slot 44 extending partially thereacross, parallel to, and spaced rearwardly of the front face 22 to receive the locating tabs of the connection device as also described further hereinafter. The transversely extending slot 44 may be extended to the converging sidewalls 24, 26 of the wall block 20, by providing depressed slot end portions 46 in the surface 40. The slot 44 is preferably about 1.625 inch wide and about 9.25 inches long and the slot ends 46 are about one inch deep.

It is to be noted that while the length of the groove and slot may be very slightly different to facilitate removal of the block from the mold, the width of the groove and slot are significantly different to accommodate the significantly different widths of the fingers and tabs of the connection device required for the normal set back of the front faces of superimposed courses of wall blocks in a retaining wall. This front to back difference in width of the central portions of the groove and slot formed by the tapered T-shaped opening is to be distinguished from a slight taper that may be found in forming through-openings in a molded product to simply facilitate separation of the product from the molding elements.

A rear wall of the slot 44 is located approximately 4.525 inches from rear wall portions 32, 34. The depressed slot ends 46 are formed during the high-speed production process described hereinabove at the same time, and from the same side, as the through-opening 41.

In a similar manner, the surface 40 of the block 20 is recessed at 48 to provide, forwardly of the slot 44, an offset portion 50, and rearwardly of the slot 44, downwardly inclined portions 52 which extend to two small flat areas 54 on either side of the arcuate cut-out 36. The offset portion 50 is spaced from the surface 40 by shoulder 56, approximately ⅜ inch in height, to accommodate a thickened cross-bar in the end portions of a uniaxial geogrid or the like as discussed in more detail hereinafter. Downwardly inclined portions 52 are spaced from the surface 40 at its leading edge by about 5/16 inch to accommodate the strands or fingers of such a geogrid. Thus, the only portions of the geogrid engaged between the cementitious surfaces of superimposed modular wall blocks 20 in use are minor portions of the rearwardly extending strands of the geogrid which may be engaged by the small flat areas 54.

The sidewalls 24, 26 taper slightly inwardly from front face 22 until reaching a point beyond the slot ends 46, after which the portions 28, 30 taper inwardly at an angle of approximately 38°, until reaching the rear wall portions 32, 34 below the flat areas 52. The arcuate cut-out 36 located between rear wall portions 32, 34 saves on overall weight of the block. It may also be useful in handling the block by providing thumb-engaging central portions 64 which cooperate with finger-engaging portions of the groove 42 or an additional through-opening 68 to facilitate lifting and placing the blocks in constructing a retaining wall.

Figure 5:
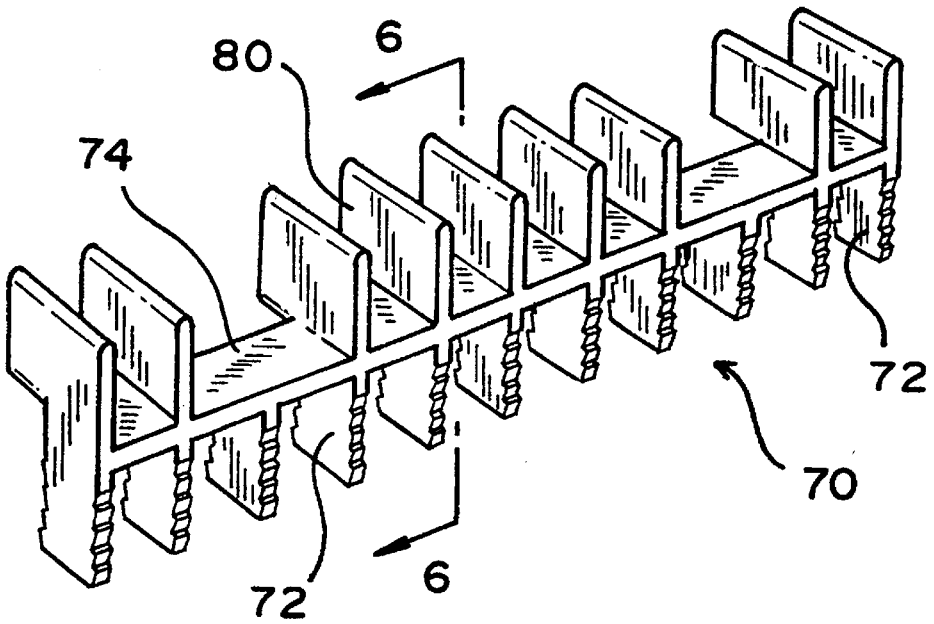
FIG. 5 is a perspective view of a connection device for use in connection with the wall blocks of the present invention so as to vertically align or vertically stagger the front faces of superimposed courses of wall blocks.
Figure 6:
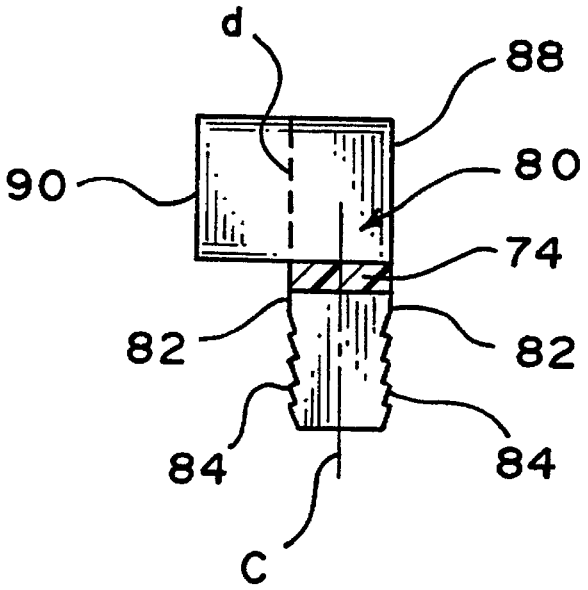
FIG. 6 is a sectional view taken along line 6—6 of FIG. 5.
Figure 8:
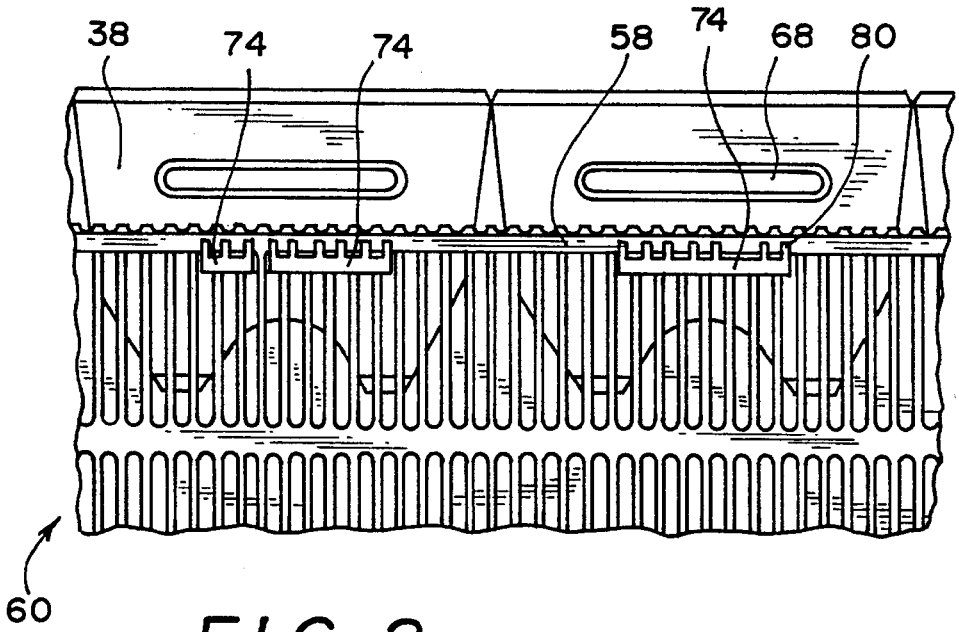
FIG. 8 is a plan view of a course of basic wall blocks with a section of geogrid secured to two of the wall blocks by a connection device according to the instant inventive concepts.

Details of one form of a preferred connection device are shown at 70 in FIGS. 5 and 6. The connection device 70 includes a plurality of fingers 72 extending substantially parallel to each other and interconnected at one end by a spine 74. For use with the basic wall block of this invention, the length of the spine 74 is preferably equal to, or less than, the length of the groove 42 which extends transversely partially across the width of each block 20. The fingers 72 of the grid connection device 70 are spaced apart by a distance equal to, or a multiple of, the spacing between the openings 76 formed by bars 58 and strands 62 of a grid-like sheet of material 60. See, particularly, FIGS. 8–10.

Figure 9:
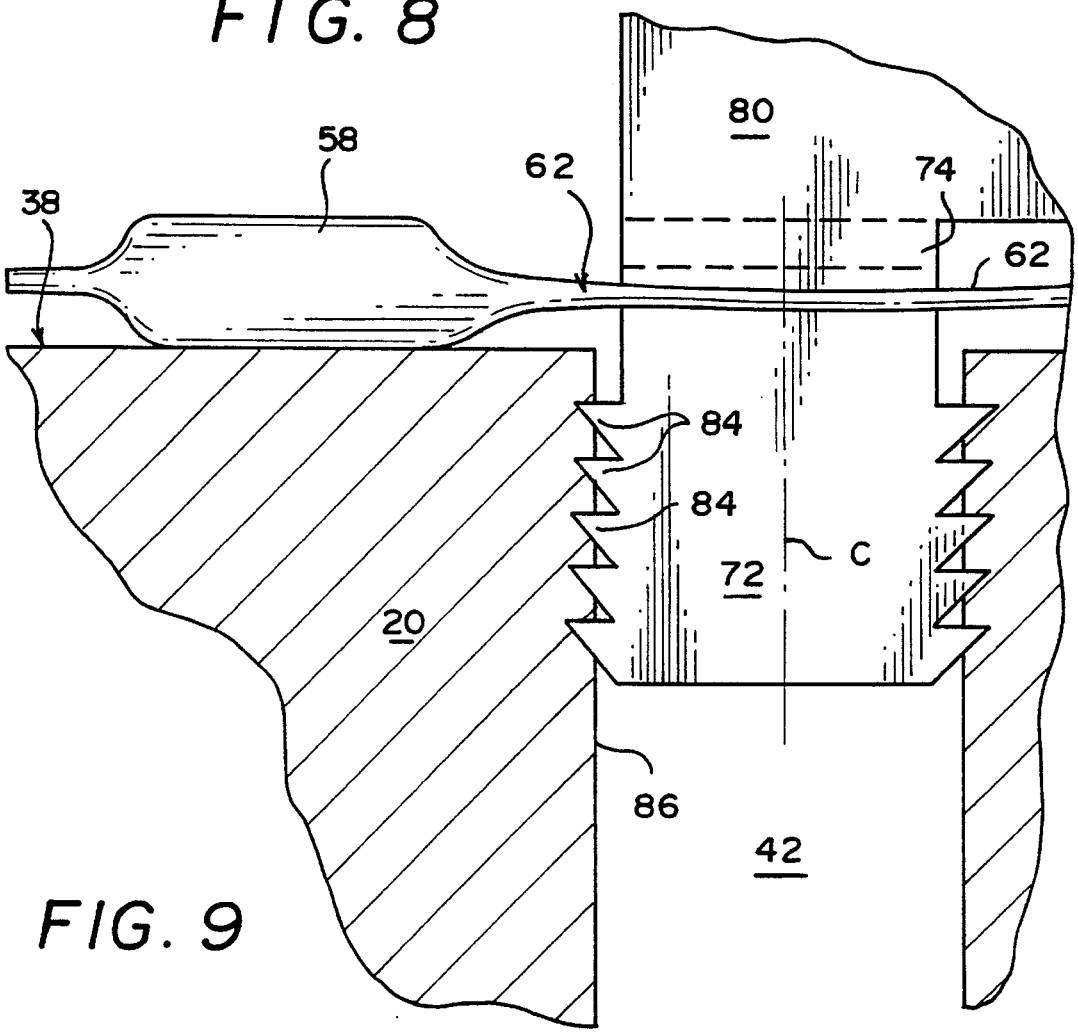
FIG. 9 is an enlarged fragmentary sectional view of end portions of a uniaxially oriented geogrid secured to the top surface of a basic wall block made in accordance with this invention.

As shown in detail in FIG. 6, the fingers 72 preferably include lateral sidewalls 82, which include, proceeding downwardly from spine 74, a plurality of spike projections 84. Spike projections 84 extend approximately 1/16 inch beyond the sidewalls 82 of the fingers 72. Each spike projection 84 has an overall height of approximately 3/16 inch. In FIG. 9, the spike projections 84 are schematically shown engaging a sidewall 86 of groove 42.

Due to the resilient nature of the material of the connection device 70, the spike projections 84 are driven downwardly along the sidewalls 86 of the groove 42 for frictional engagement with the sidewalls 86. By the angle of inclination of the spike projections 84, it is possible to drive the fingers 72 downwardly into the groove 42 whereas considerable force would be required to extricate the connection device 70 from the groove 42, such a force being far greater than would be expected during seismic eruptions with vertical accelerations.

Spaced across the connection device 70 on a side of the spine 74 opposite to that of the downwardly projecting fingers 72 are upwardly extending locating tabs 80. The fingers 72 have a central axis "c"; the tabs 80 have a central axis "d" laterally spaced from central axis "c" of fingers 72. A tab 80 preferably extends above the spine 74 in alignment with a majority of the downwardly projecting fingers 72, although the tabs 80 need not be aligned with the fingers 72 and for some applications only a limited number of tabs may be desirable. Further, the tabs 80 may form a single bar (not shown) connected to an upper end of the fingers 72, thereby avoiding the need for a spine.

Preferably, an overall width of the tab 80 is 1.375 inches. In combination, the height of the connection device from the top of the tab 80 to the bottom of the finger 72 is approximately 2.125 inches.

The tabs 80, in the preferred embodiment, include one lateral edge 88 in alignment with one lateral edge of the fingers 72. It is also possible for the lateral edges 88 of the tabs 80 to be offset inwardly or outwardly from the lateral edges of the fingers 72. However, the opposite lateral edges 90 of the tabs 80 projects beyond the other lateral edges of the fingers 72 by a distance approximating the difference in width between the groove 42 and the slot 44. This relationship may be defined by central axis "c" of the fingers 72 being laterally offset from central axis "d" of the tabs 80 by about ½ that distance.

Figure 7:
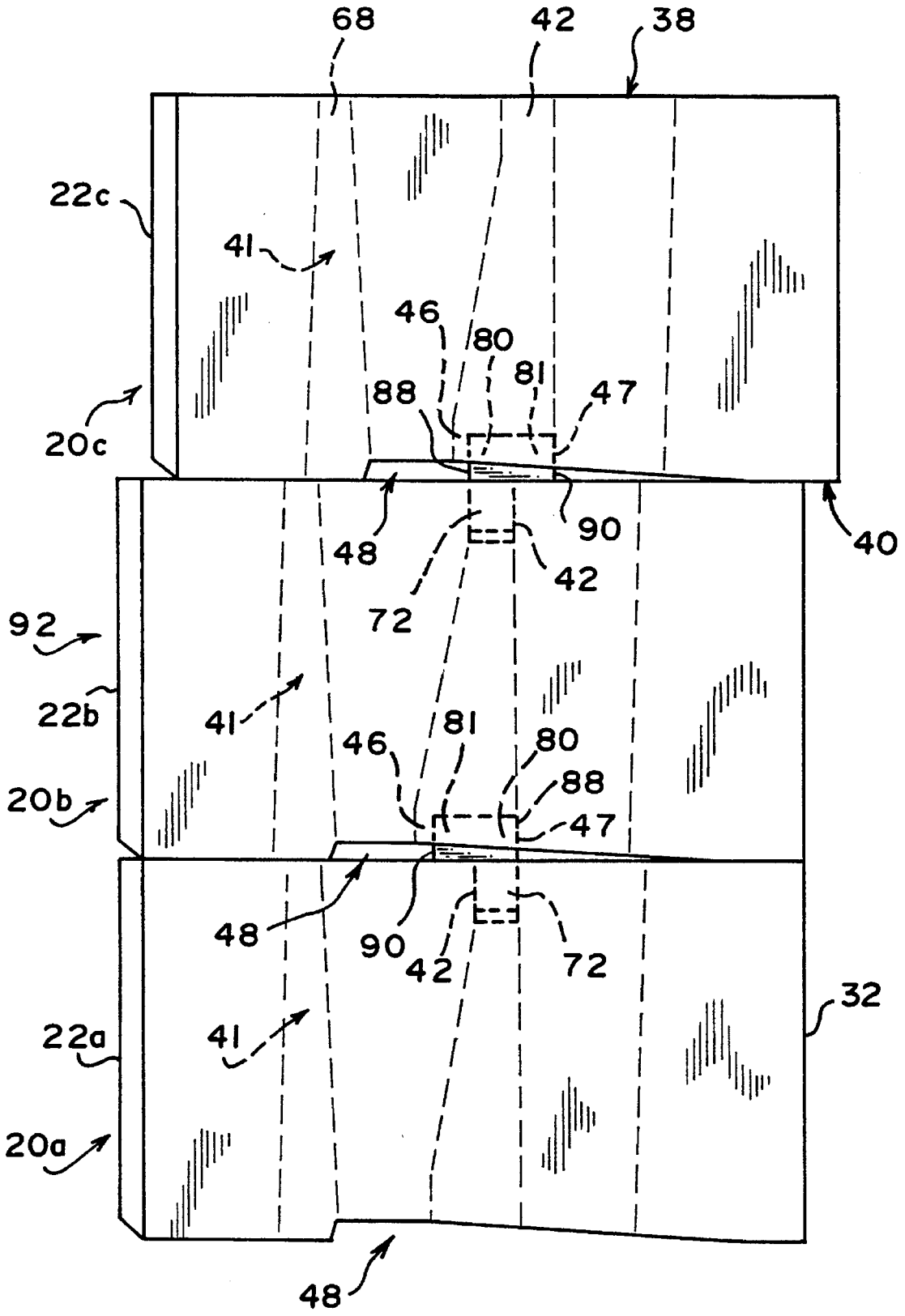
FIG. 7 is a sectional view of a retaining wall made in accordance with the principles of the present invention with the front faces of the two lower courses of basic wall blocks shown in a vertically aligned orientation and the front faces of the two upper courses of basic wall blocks shown in a vertically offset orientation.

In constructing a retaining wall 92, such as is shown in FIG. 7, a first course of basic modular wall blocks 20*a* according to this invention, is positioned side by side in the usual manner. The fingers 72 of a connection device 70 are secured in the grooves 42 in the upper surfaces 38 of each wall block with the offset portion 81 of the tabs 80 facing forwardly as seen between superimposed wall blocks 20*a* and 20*b* in FIG. 7 if the front faces 22*a*, 22*b* of the wall blocks in the retaining wall are to be vertically aligned. Alternatively, if the front faces 22*b*, 22*c* are to be stepped rearwardly as seen in blocks 20*b* and 20*c* of FIG. 7, the fingers 72 of the connection devices 70 are engaged in the grooves 42 with the offset portions 81 of the tabs 80 facing rearwardly.

Thus, the direction of the offset portion or extension 81 of the tabs 80 of the connection device 70 selectively aligns the front faces 22 of successive courses in a retaining wall produced with the wall block system of this invention in a vertically aligned or vertically staggered orientation. More specifically, the rear wall portion 47 of the slot 44 located at the bottom of a successively higher course of wall blocks is engaged against edge 88 of tabs 80 when the front faces 22*a*, 22*b* of successive courses of wall blocks are to be positioned in a vertically aligned orientation or against edge 90 of tabs 80 when the front faces 22*b*, 22*c* of successive courses of wall blocks are to be positioned in an offset or vertically staggered orientation.

As is usual and customary in the industry in the construction of a retaining wall, after the laying of several courses of wall blocks, the courses are shimmied to be level to accommodate any variances from acceptable tolerances in the construction of the wall blocks. The width of the slot 44 is intended to be approximately ¼ of an inch wider than the width of the tab 80 to allow some play in the positioning of a successively higher course of modular wall blocks and to permit superimposed wall blocks, which are usually laterally staggered with respect to the blocks in a lower course, to be easily slid sideways during construction.

The difference in width between the slot 44 and the tab 80, also allows for some degree of curvature of a retaining wall having a radius of curvature of greater than about 60 feet. It is understood as being within the scope of the present invention to increase the width of the slot 44 if a lesser minimum radius of curvature is desired.

Figure 10:
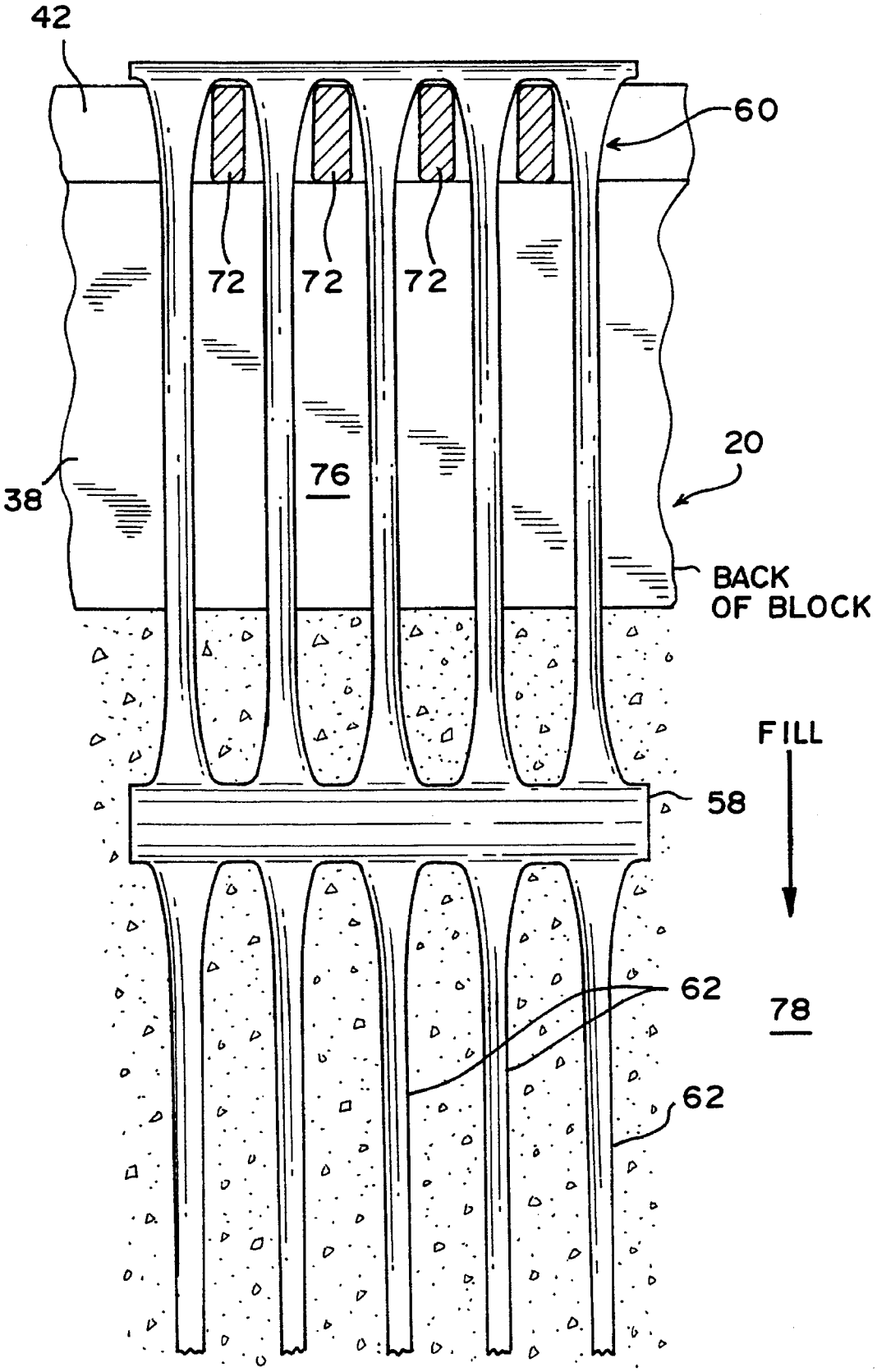
FIG. 10 is a plan view, with a section taken of the connection device, to illustrate the fingers of the connection device passing through the openings in end portions of a sheet of geogrid to secure the geogrid to a groove formed in the top surface of a basic wall block.

In FIGS. 8–11 a retaining wall 94*a* is illustrated using the basic modular wall blocks of this invention connected to lengths of uniaxially stretched geogrid 60 designed to reinforce the wall by extending rearwardly from the blocks into backfill material 78. The geogrid 60 is placed on the upper surface 38 of a block 20 with a transverse bar 58 forwardly of the groove 42 and the strands 62 spanning the groove. The fingers 72 of a connection device 70 pass through the apertures 76 of the geogrid and the spine or crossbar 74 captures the end portions of the geogrid and fixedly secures the same to the modular wall block with the remainder of the grid-like sheet of material 60 extending rearwardly from the block 20 into the soil or other particulate material 78 as best seen in FIG. 10.

The tabs 80 and spine 74 of the connection device 70, and all portions of the grid-like sheet of material 60 passing over the upper surface 38 of the block 20, are above the level of the upper surface 38 of the block 20. Depending on the spacing between the strands 62 of the grid-like sheet of material 60, it is possible that there will be limited portions of a strand or two of the grid-like sheet of material compressed between an upper surface 38 of a block 20 and the small flat areas 54 of a superimposed block. However, this minimal frictional engagement is of little consequence and would not significantly affect the secure engagement between the connection device 70 and the modular block 20 which prevents shifting of the grid-like sheet of material during a seismic eruption.

The section of grid-like sheet of material 60 illustrated in the drawings is representative of an extended length of grid-like sheet of material which is to be secured to a modular wall block 20 and typically measures four feet wide in the direction of the junction bars 58, and anywhere from four to twenty-five feet or more in length in the direction of the longitudinal axis of the strands 62.

Figure 11:
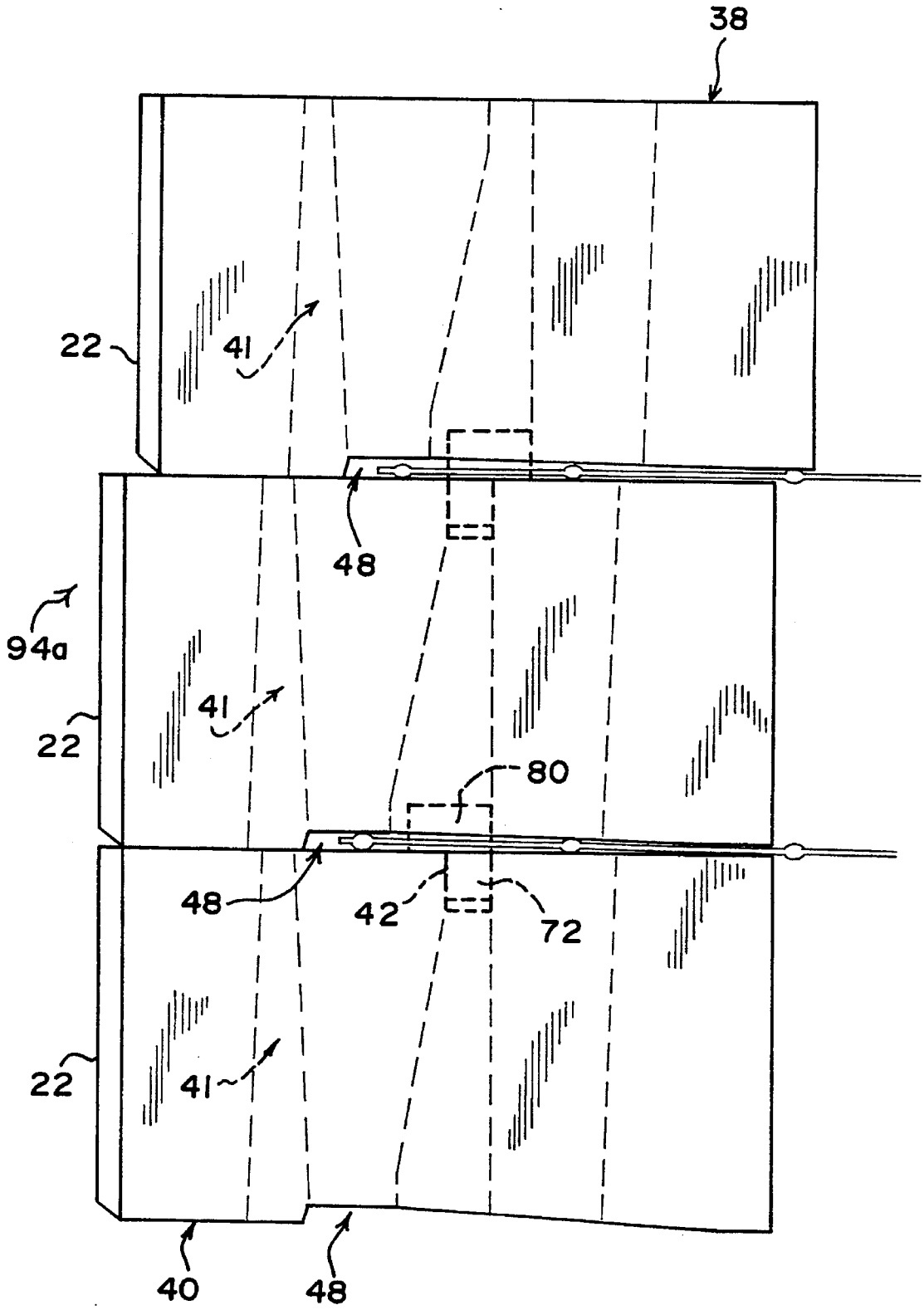
FIG. 11 is a sectional view of a retaining wall made in accordance with the principles of the present invention with sections of geogrids secured between successive courses of basic wall blocks and with the connection device between the lower two courses of wall blocks aligning the front faces in a vertically aligned orientation and the connection device between the upper two courses of wall blocks being reversed so as to position the front faces in a vertically offset orientation.
Figure 12:
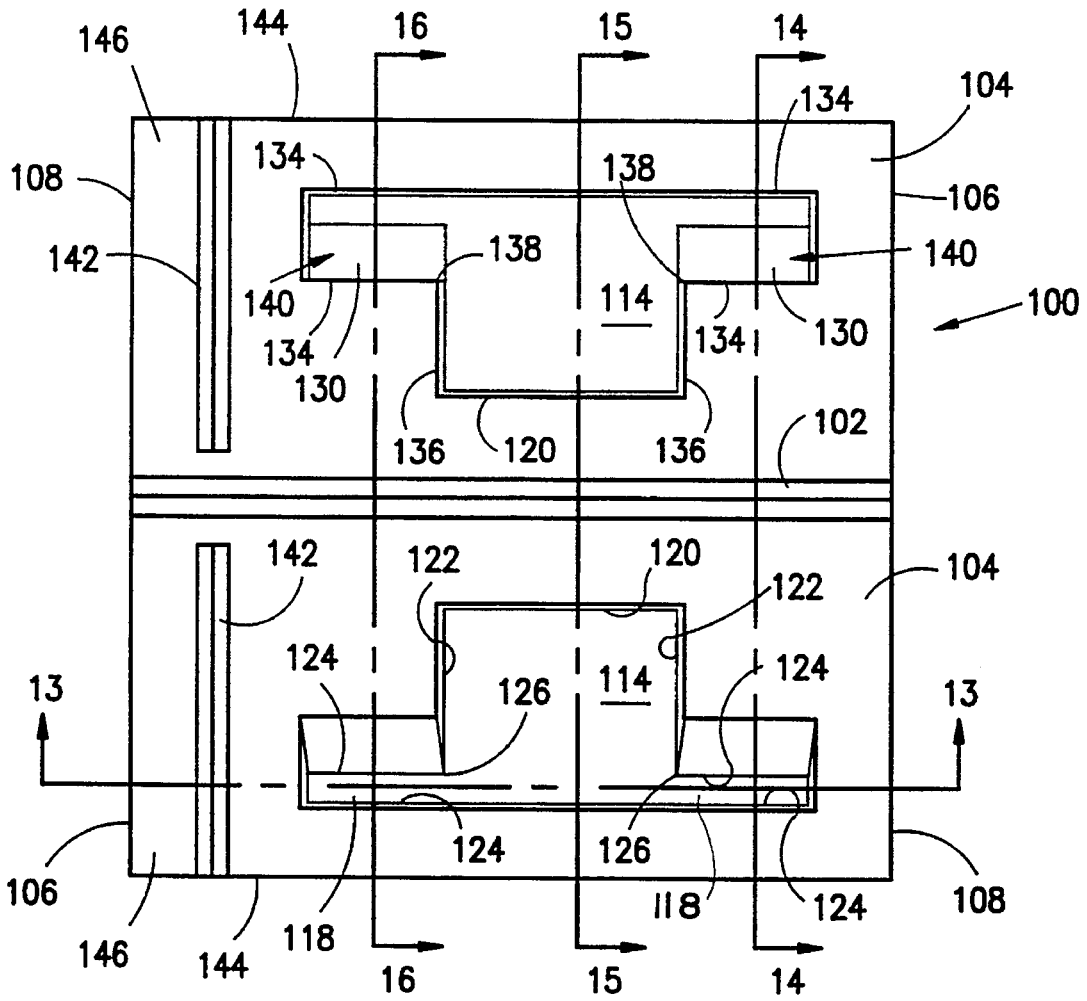
FIG. 12 is a plan view of an alternate embodiment of a molded double wall block which, when split and inverted, forms two separate wall blocks with jaggered front faces, and which includes additional splitting grooves to form a jagged side surface when the block is used as a corner block.
Figure 13:
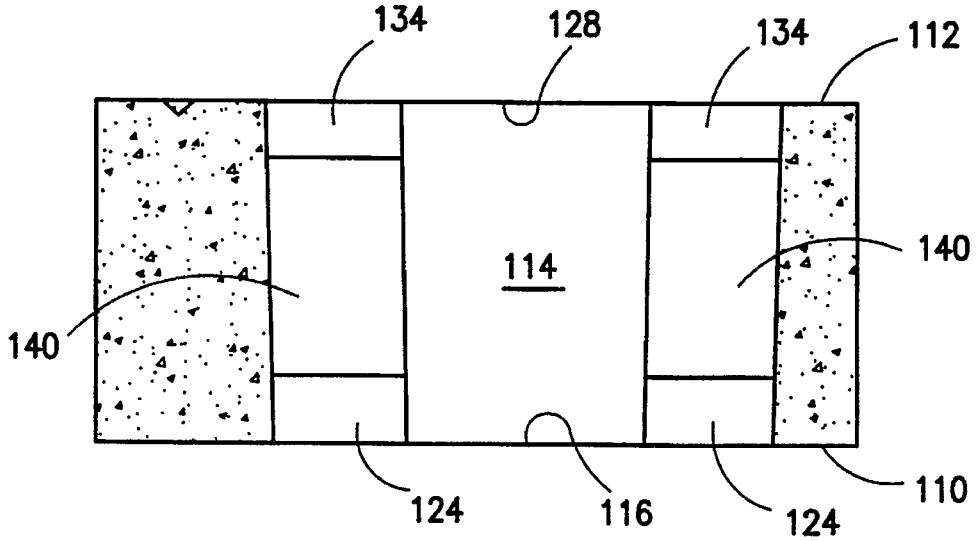
FIG. 13 is a sectional view taken along line 13—13 of FIG. 12.
Figure 14:
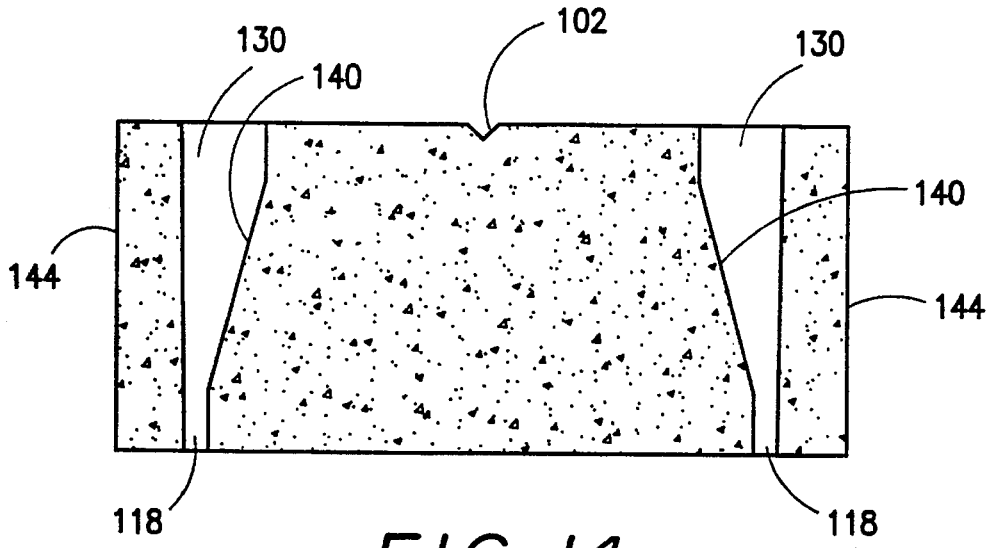
FIG. 14 is a sectional view taken along line 14—14 of FIG. 12.
Figure 15:
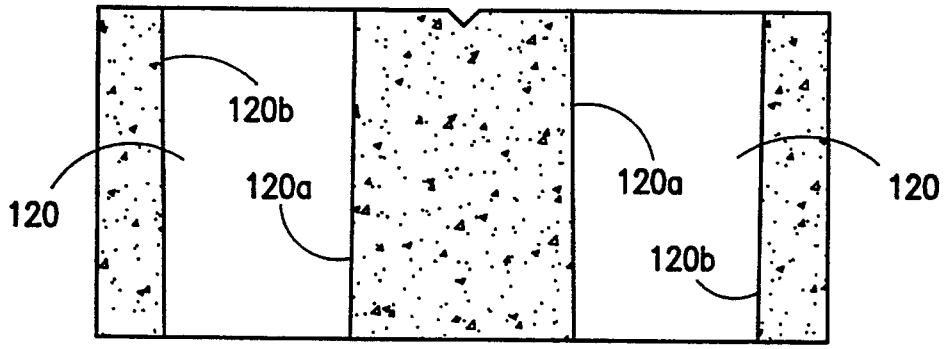
FIG. 15 is a sectional view taken along line 15—15 of FIG. 12.
Figure 16:
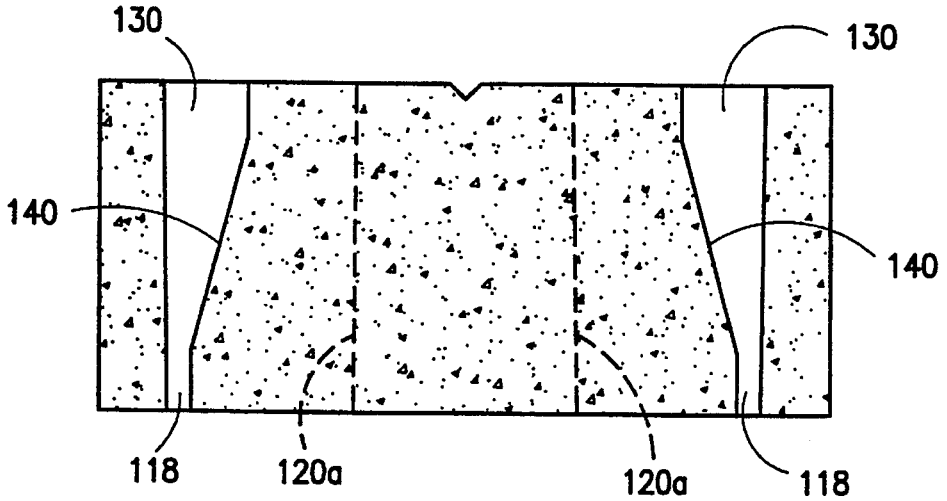
FIG. 16 is a sectional view taken along line 16—16 of FIG. 12.

In constructing a retaining wall 94*a* such as shown in FIG. 11, lengths of grid-like sheet of materials 60 may be secured to selected wall blocks 20 by a connection device 70 as described above before laying upper blocks thereon. The grid-like sheet of material 60 may extend across a width involving a plurality of modular blocks 20. For each modular block 20 to which a section of grid-like sheet of material 60 is secured, a separate grid connection device 70 is preferably used to facilitate the construction process and create a positive mechanical connection.

The area behind the rear faces 32, 34 of the blocks 20 is progressively backfilled with soil or other aggregate 78 as the courses are laid to secure the extended lengths of sections of grid-like sheet of material 60 within the fill material 78. The grid-like sheet of material 60 functions to reinforce the fill 78 and thereby create a contiguous mass in a well known manner.

Preferably, slot 44 in combination with slot ends 46 extends transversely across block 20 between sides 24 and 26, at its bottom surface 40. This construction is desirable especially when the superimposed blocks are laterally staggered in building the retaining wall as is commonly done. Thus, at least some of the tabs 80 of a connection device 70 captured in the limited central groove 42 in the top surface of a lower block may be received in the slot edge portions 46 of a slot 44 in a pair of laterally staggered superimposed blocks. In the absence of depressed slot end portions 46, positioning of the tabs of a connecting device would need to be more carefully monitored to ensure correct placement in the central portion of the slot 44 thereabove.

The recessed portion in the block described in the aforementioned '324 application is provided in the top of the block as used to accommodate the bars/strands of the geogrid. In the present invention, since the blocks are manufactured upside-down, all patterns must be formed in the top surface during manufacturing, which becomes the bottom surface in use; yet, the recess in the bottom surface still functions to accommodate geogrid, as seen particularly in FIG. 11, much as it did in prior arrangements thereby avoiding unnecessary contact between the rough block surfaces and the polymer grid in use.

With reference to FIGS. 12 through 17, an alternate embodiment of a modular wall block in accordance with the principles this invention is shown. As with the previous embodiment initially a double block 100 is molded with a peripheral groove 102, which may be impacted with a chisel or pointed device (not shown) to split the double block 100 apart to form a pair of modular wall blocks 104, each of which will have an aesthetic jagged front face 105.

For ease of manufacture, the double blocks 100 are cast upside down with reference to their orientation in use. FIGS. 12–16 show the double block 100 as cast, with the understanding that the wall blocks 104 resulting from splitting a double wall block 100 will be inverted when used to construct a retaining wall therefrom.

Each wall block 104, in addition to the front face 105, includes a rear face 144, parallel to the front face 105, parallel side walls 106, 108, a first surface 110 which will be the upper surface of the wall block in use, and a second surface 112 which will be the lower surface of the wall block in use. The first and second surfaces 110 and 112, also extend parallel to each other.

If the wall blocks 104 are to be used as corner blocks each block is provided with a further groove 142 extending from the rear wall 144 toward the front wall 105 to form a jagged side face 148 for aesthetic continuity of the retaining wall surface as will discussed below with particular reference to FIG. 17. If the blocks are to be used in non-corner positions, either the end section 146 is removed, the wall blocks are molded without this section, or the dimensioned relationship with respect to a particular connection device can be arranged to accommodate retention of the end section. End sections can be provided on either side of the center line of the wall block 104 for forming opposite corners of a retaining wall, but this is not generally necessary since the wall blocks 104 may simply be inverted to present the jagged face 148 at either side.

A tapered T-shaped through-opening 114 extends through each block 104 between surfaces 110 and 112. Through-opening 114 terminates in T-shaped apertures 116, 128 in the surfaces 110, 112, respectively. The T-shaped aperture in each surface includes a stem section 120 and a pair of arm sections defining the cross-bar of the T.

In the first surface 110 (the upper surface of the block 104 in use), the aligned arm sections 118, together with portions of the stem section 120, define a groove which is parallel to, and set back from, the front face 105, the groove stopping short of each side wall of the block 104. Likewise, in the second surface 112 (the lower surface of the block 104 in use), the aligned arm sections 130, together with portions of the stem section 120, define a slot which is parallel to, and set back from, the front face 105, the slot also stopping short of each side wall of the block 104. As in the basic wall block, the slot in each alternate block 104 is somewhat wider than the groove. The groove and slot in the alternate wall block interact with the fingers and tabs of a connecting device in much the same manner as the groove and slot in the wall blocks 20 of the previous embodiment to interconnect superimposed walls blocks in a retaining wall, secure a geogrid or the like thereto, if desired, and selectively position the front faces of stacked courses of wall blocks in a vertical or stepped back orientation. Additionally, since the side surfaces of the alternate wall blocks 104 are perpendicular to the front, may be provided with a jagged surface like the front face, and are continuous, i.e., the grooves and slots do not extend to the side surfaces of the wall blocks 104, they can be effectively used to form corners in a retaining wall having portions extending at right angles to each other.

Referring now in more detail to the blocks 104, the stem section 120 of the T-shaped through-opening 114 includes two parallel side walls 122 interconnected with the front wall of parallel front and rear walls 124 of the arm sections 118 of the groove at right angle intersections 126 and the front wall of parallel front and rear walls 134 of the arm sections 130 of the slot at right angle intersections 138. A tapered surface 140 extends between the front walls 124 of the arm sections 118 of the groove and the front walls 134 of the arm sections 130 of the slot. The stem section 120 includes front wall **120*a* and rear wall 120*b* and is approximately 3.8 inches wide (from front to rear) and about 5.75 inches long (from side to side) on the surface 110, and approximately 4 by 6 inches on the surface 112 because of the taper of the through-opening 114. The stem section of the through-opening 114** lightens the block and facilitates lifting and placing blocks in constructing a retaining wall.

Preferably, the arm sections 118 of the groove are 0.75 inches wide (from front to rear) and the arm sections 130 of the slot are 1.6 inches wide. The groove, including the arm sections 118 and the connecting portion of the stem section 120 is about 11.75 inches long (from side to side), with the slot defined by the arm sections 130 and the interconnecting portion of the stem section 120 being about 12 inches wide because of the taper of the through-opening 114.

Figure 17:
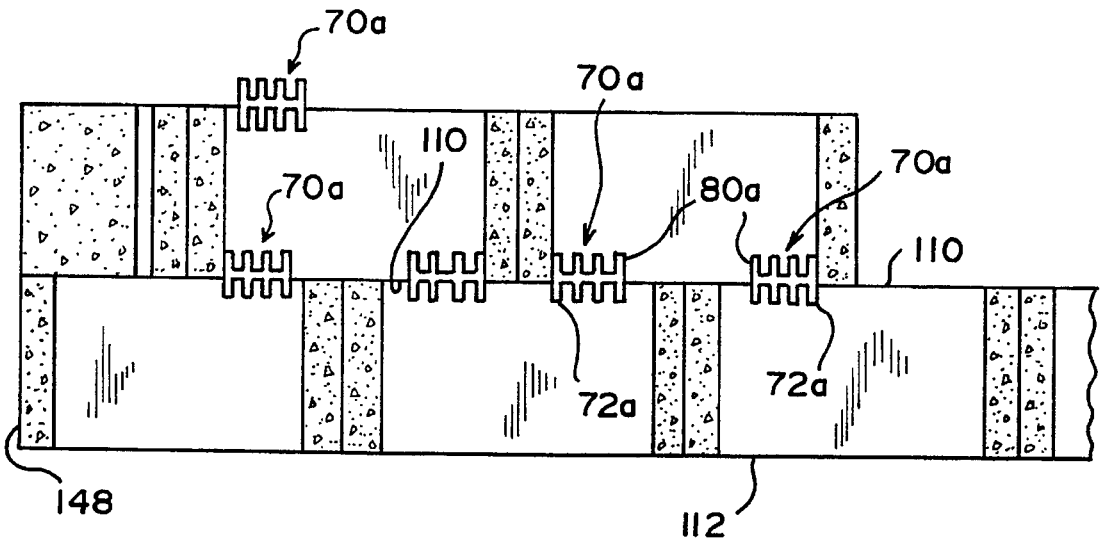
FIG. 17 is a schematic sectional view of a retaining wall constructed of the alternate wall blocks according to this invention, with short sections of connection devices used to interconnect the superimposed courses and selectively locate the front faces in vertically aligned or stepped back relationship.

If the wall blocks 104 are staggered in superimposed courses it will be necessary to provide a short version of the connection device as shown schematically at **70*a* in FIG. 17. The fingers 72*a* of the connection device 70*a* are driven into the arm sections 118 of the groove so as to engage the side walls 124 much like the previous embodiment. However, since the slots do not extend to the side edges of the wall blocks 104, and superimposed courses of wall blocks 104 are laterally staggered, the connection device 70*a* must be limited in length so as to fit within the arm sections 130 of the slots. Thus, as in the previous embodiment of wall block 20, according to the principles of the present invention, the upwardly extending locating tabs 80*a* of the connection device 70*a* project above surface 110 of a lower course of wall blocks 104 and will be accommodated within the arm sections 130 of the slot defined in the lower surface 112 of a pair of blocks 104 in an upper course. Since individual blocks in successive courses of the blocks are laterally staggered with respect to a successively lower course of wall blocks, the placement of the connection device 70*a* within the arm sections 118 of the grooves is more significant so as to align with the arm sections 130 of the slots on a successively higher course of wall blocks as schematically shown in FIGS. 17**.

Figure 18:
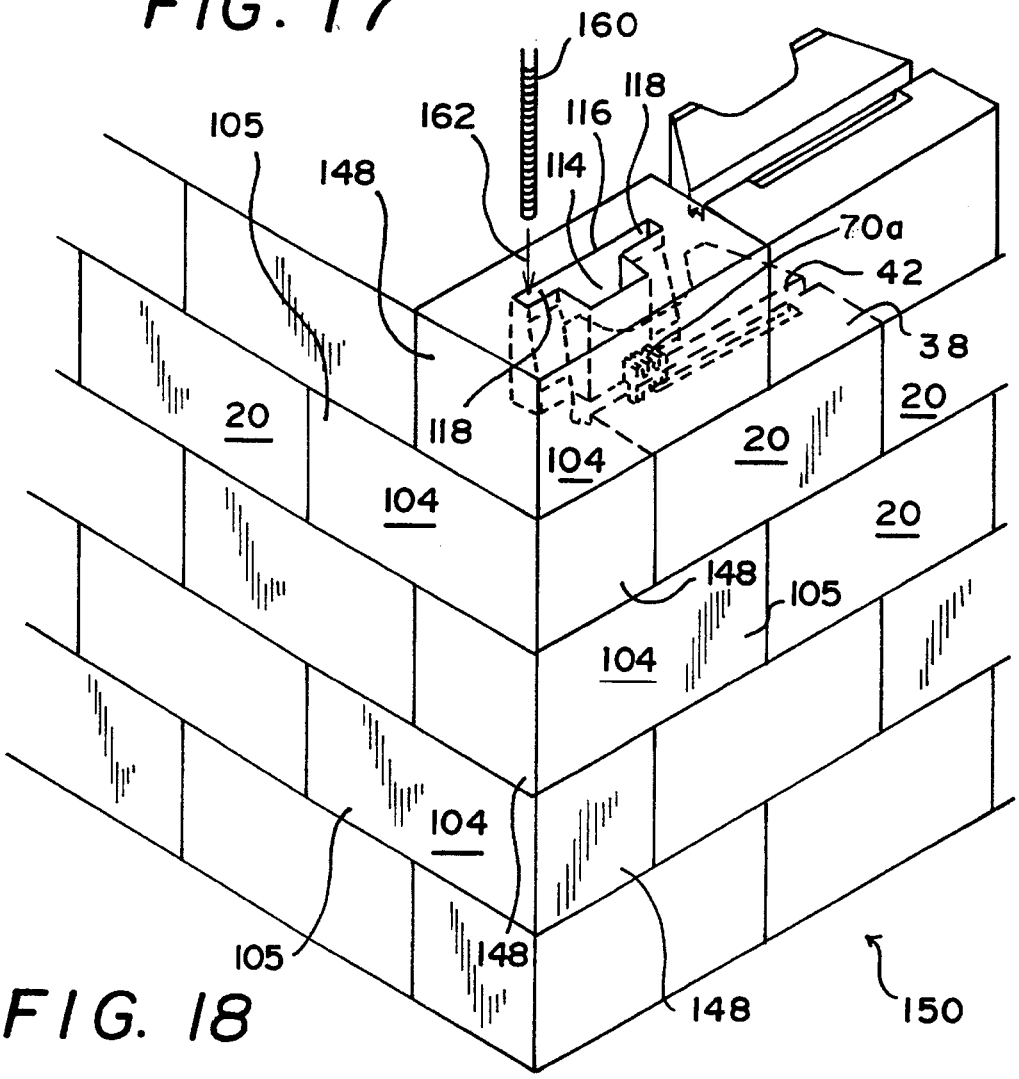
FIG. 18 is a hybrid retaining wall having perpendicularly extending sections formed primarily of the basic wall blocks of this invention as shown in FIGS. 1 through 4 with the alternate wall blocks of FIGS. 12 through 16 used as corner blocks.

In FIG. 18 a hybrid retaining wall is schematically shown at 150 including a multiplicity of basic wall blocks 20 as described with particular reference to FIGS. 1–7 hereof in combination with alternate wall blocks 104 as shown particularly in FIGS. 12–16 used to form a right-angled corner portion of the retaining wall. Although the front faces of the block are shown in a vertically aligned orientation, it is understood that according to the principles of the invention, the front faces may be arranged in a stepped back orientation.

The straight portions of the retaining wall 150 is formed by interconnecting basic wall blocks 20 with connector devices 70, with or without sections of geogrid or the like (not shown) as described in detail above with respect particularly to FIGS. 7–11. Where the corner blocks 104 are used, the teeth **72*a* of a shortened connector device 70*a* is secured in a groove 42 of a basic wall block 20 with the tabs 80*a* projecting upwardly into the arm sections 130 of the slot of a superimposed block 104 to anchor the blocks adjacent to the corner of the retaining wall. It may be desirable to insert a bar as shown at 160 in the direction of arrow 162 through the arm sections 118, 130 of successively lower blocks 104 until the ground is engaged so as to interconnect the blocks 104 at the corner of wall 150**.

Having described the invention, many modifications thereto will become apparent to those skilled in the art to which it pertains without deviation from the spirit of the invention as defined by the scope of the appended claims.

We claim:

1. A modular wall block comprising:

a front face, a rear face, an upper surface, a lower surface, and opposed sidewalls defining side faces extending between said upper and lower surfaces and said front and rear faces, a groove defined in one of said upper and lower surfaces parallel to, and spaced rearwardly of, said front face for receiving portions of a connector device, and a slot defined in the other of said surfaces parallel to, and spaced rearwardly of, said front face, for receiving other portions of the connector device so as to position the front faces of a superimposed course of wall blocks with respect to each other in one of a vertically aligned and vertically set back orientation, said groove and said slot being at least partially defined by opposite ends of a through-opening extending from said one surface of said block to said other surface, said through-opening being tapered so that said groove and said slot are of different front to rear widths, said groove and said slot each extend only over central portions of said one and said other surfaces of said block, respectively, and stop short of said side faces, said through opening being T-shaped and defining T-shaped apertures in each of said surfaces, each T-shaped aperture including central stem section extending toward said front and rear faces of said block, and aligned am sections extending outwardly from the rear end of said stem section parallel to said front face and toward respective sidewalls of said block, said arm sections at said one end of said through-opening each defining said groove in said one surface of said block, and said arm sections at said other end of said through-opening each defining said slot in said other surface of said block.

2. A modular wall block as claimed in claim 1, wherein said front face and said at least one side face each include similar aesthetic patterns formed therein.

3. A modular wall block system to be used for forming a retaining wall, said modular wall block system comprising:

a plurality of wall blocks each having a front face for forming a portion of an exterior surface of the retaining wall, a rear face, upper and lower surfaces, and opposed sidewalls defining side faces extending between said upper and lower surfaces and said front and rear faces, connector devices for interconnecting superimposed courses of said wall blocks with successively lower courses in the retaining wall, a groove defined in one of said surfaces of each wall block parallel to, and spaced rearwardly of, said front face for receiving first portions of one of said connector devices, and a slot defined in the other of said surfaces of each wall block parallel to, and spaced rearwardly of said front face, for receiving other portions of said connector device so as to position the front faces of superimposed courses of wall blocks with respect to each other in one of a vertically aligned and vertically set back orientation, said groove and said slot in each wall block being at least partially defined by opposite ends of a through-opening extending from said one surface of said block to said other surface, said through-opening being tapered so that said groove and said slot are of different front to rear widths.

4. A modular wall block system as claimed in claim 3, wherein said slot extends continuously between said sidewalls on said other surface of each block and includes a central portion defined by one end of said through-opening and side portions defined by depressions in said other surface of said block on each side of said central portion.

5. A modular wall block system as claimed in claim 3, further including a recessed portion defined in said other surface of each wall block extending forwardly and rearwardly of said slot to accommodate terminal portions of a grid-like sheet of reinforcing material to be secured to said other surface of a lower course of wall blocks by the connection device.

6. A modular wall block system as claimed in claim 3, wherein at least some of said wall blocks are corner blocks to be used in forming a retaining wall having sections extending at right angles to each other, at least said corner blocks include a front face and at least one side face extending at right angles to each other, each of which define portions of the respective sections of the retaining wall face.

7. A modular wall block system as claimed in claim 6, wherein said front face and said at least one side face of said corner blocks include similar aesthetic patterns formed therein.

8. A modular wall block system as claimed in claim 6 wherein, at least in said corner blocks, said groove and said slot each extend only over central portions of said one and said other surfaces of said block, respectively, and stop short of said side faces.

9. A modular wall block as claimed in claim 8 wherein, said through-opening is T-shaped and defines T-shaped apertures in each of said surfaces, each T-shaped aperture including a central stem section extending toward said front and rear faces of said block, and aligned arm sections extending outwardly from the rear end of said stem section parallel to said front face and toward respective sidewalls of said block, said arm sections at said one end of said through-opening each defining a groove in said one surface of said block, and said arm sections at said other end of said through-opening each defining a slot in said other surface of said block.

10. A modular wall block system as claimed in claim 3, wherein said first portions of said connector device includes a plurality of finger members and said other portions of said connector device include at least one tab extending away from said finger members, a central axis of said finger members being spaced from a central axis of said at least one tab.

11. A modular wall block system as claimed in claim 3, further comprising a sheet of reinforcing material having end portions to be secured to selected wall blocks with the remainder of the sheet of material extending rearwardly into fill material behind the retaining wall to reinforce the retaining wall.

12. A modular wall block system as claimed in claim 11, wherein said end portions of said sheet of reinforcing material defines a plurality of laterally spaced openings, said first portions of said connector device to be passed through said spaced openings of said sheet of reinforcing material to be frictionally received in said groove in said one surface of said selected wall blocks with additional portions of said connector device overlying portions of said sheet of reinforcing material and thereby securing said sheet of reinforcing material to said selected wall blocks.

13. A retaining wall comprising:

a plurality of courses of superimposed wall blocks, each wall block having a front face forming a portion of an exterior surface of the retaining wall, a rear face, upper and lower surfaces, and opposed sidewalls defining side faces extending between said upper and lower surfaces and said front and rear faces, connector devices interconnecting superimposed courses of said wall blocks to successively lower courses of wall blocks, a groove defined in one of said surfaces of each wall block parallel to, and spaced rearwardly of, said front face, first portions of a connector device frictionally received in said groove, a slot defined in the other of said surfaces of each wall block parallel to, and spaced rearwardly of said front face, other portions of said connector device received in said slot so as to position the front faces of superimposed courses of wall blocks with respect to each other in one of a vertically aligned and vertically set back orientation, said groove and said slot in each wall block being at least partially defined by opposite ends of a through-opening extending from said one surface of said block to said other surface, said through-opening being tapered so that said groove and said slot are of different front to rear widths, and fill material located behind said rear face of said wall blocks for reinforcing said retaining wall.

14. A retaining wall as claimed in claim 13, wherein said slot extends continuously between said sidewalls on said other surface of each block and includes a central portion defined by one end of said through-opening and side portions defined by depressions in said other surface of said block on each side of said central portion.

15. A retaining wall as claimed in claim 13, further including a recessed portion defined in said other surface of each wall block extending forwardly and rearwardly of said slot to accommodate terminal portions of a sheet of reinforcing material secured to said other surface of a lower course of wall blocks by a connection device.

16. A retaining wall as claimed in claim 13 having sections extending at right angles to each other, at least some of said wall blocks being corner blocks, at least said corner blocks including a front face and at least one side face extending at right angles to each other, each of which define portions of said respective sections of the retaining wall.

17. A retaining wall as claimed in claim 16 wherein said front face and said at least one side face of said corner blocks include similar aesthetic patterns formed therein.

18. A retaining wall as claimed in claim 16 wherein at least in said corner blocks, said groove and said slot each extend only over central portions of said one and said other surfaces of said block, respectively, and stop short of said side faces.

19. A retaining wall as claimed in claim 18 wherein, said through-opening is T-shaped and defines T-shaped apertures in each of said surfaces, each T-shaped aperture including a central stem section extending toward said front and rear faces of said block, and aligned arm sections extending outwardly from the rear end of said stem section parallel to said front face toward respective sidewalls of said block, said arm sections at said one end of said through-opening each defining a groove in said one surface of said block, and said arm sections at said other end of said through-opening each defining a slot in said other surface of said block.

20. A retaining wall as claimed in claim 13, wherein said first portions of said connector device includes a plurality of finger members and said other portions of said connector device include at least one tab extending away from said finger members, a central axis of said finger members being spaced from a central axis of said at least one tab.

21. A retaining wall as claimed in claim 13, further comprising a sheet of reinforcing material having end portions secured to selected wall blocks with the remainder of the sheet of reinforcing material extending rearwardly into said fill material behind the retaining wall to reinforce the retaining wall.

22. A retaining wall as claimed in claim 21, wherein end portions of said sheet of reinforcing material define a plurality of laterally spaced openings, first portions of said connector device passing through said spaced openings of said sheet of reinforcing material and frictionally received in said groove in said one surface of said selected wall blocks, additional portions of said connector device overlying portions of said sheet of reinforcing material and thereby securing said sheet of reinforcing material to said selected wall blocks.

* * * * *